US005624202A

United States Patent [19]

Grierson

[11] Patent Number: 5,624,202

[45] Date of Patent: Apr. 29, 1997

[54] INTEGRAL JOINT AND MOUNTING ASSEMBLY FOR SUSPENDED LINEAR STRUCTURES

[75] Inventor: Dean Grierson, Port Coquitlam, Canada

[73] Assignee: Ledalite Architectural Products, Inc., Canada

[21] Appl. No.: 545,401

[22] Filed: Oct. 19, 1995

[51] Int. Cl.[6] ..... B25G 3/18

[52] U.S. Cl. ..... 403/327; 403/326; 403/380; 248/343

[58] Field of Search ..... 403/295, 296, 403/306, 326, 327, 380; 248/343, 344, 342

[56] References Cited

U.S. PATENT DOCUMENTS

| | | | |
|---|---|---|---|
| 2,383,007 | 8/1945 | Maurette | 240/78 |
| 2,923,565 | 2/1960 | Klebe | 403/327 X |
| 2,990,470 | 6/1961 | Bodian et al. | 240/51.11 |
| 3,011,047 | 11/1961 | Spaulding | 240/3 |
| 3,019,332 | 6/1962 | Schiffer | 240/9 |
| 3,070,689 | 12/1962 | McIntosh | 240/51.11 |
| 3,101,178 | 8/1963 | Young | 248/342 X |
| 3,565,385 | 2/1971 | Zurawski | 248/343 |
| 3,639,752 | 2/1972 | Appleton | 248/342 X |
| 4,039,135 | 8/1977 | Schenk | 248/342 X |
| 4,227,355 | 10/1980 | Wendt | 52/64 |
| 4,717,993 | 1/1988 | Bernhart et al. | 362/219 |
| 5,282,600 | 2/1994 | Weiss et al. | 248/343 |
| 5,335,890 | 8/1994 | Pryor et al. | 248/343 |
| 5,485,704 | 1/1996 | Sandor, Sr. | 403/380 X |

*Primary Examiner*—Brian K. Green
*Assistant Examiner*—Bruce A. Lev
*Attorney, Agent, or Firm*—William J. McNichol

[57] ABSTRACT

An assembly and method for mounting linear structures in locked longitudinal alignment, which includes retainer bars joinable to a bracket for mounting linear structures and a pin assembly having wedge pins protruding outwardly from a base wherein the wedge pins engage opposing apertures in a locked, spring-loaded interface tightened into alignment by a retainer screw. The locked interface between opposing edges of the wedge pin and the apertures impart strong resistance to displacement forces, thereby providing a system for joining and mounting permitting adjustment and alignment of independently suspended linear structures and subsequent tightening down of the linear structures.

12 Claims, 3 Drawing Sheets

INTEGRAL JOINT AND MOUNTING ASSEMBLY FOR SUSPENDED LINEAR STRUCTURES

FIELD OF THE INVENTION

The present invention relates to joint and mounting assemblies for suspended linear structures, particularly lighting and other fixtures.

BACKGROUND OF THE INVENTION

Modular suspended linear structures are typically assembled in place by connecting and mounting individual modules. Typical linear structures suspended from joint and mounting assemblies include linear fluorescent lighting systems. Such lighting fixtures may radiate light upwardly against the ceiling or downwardly toward the work area. Imprecise interfitting of such modular lighting systems results in an unsightly and unprofessional appearance and in spaces in the completed assembly, through which light radiates when switched on.

To avoid such undesirable finishes, strict alignment tolerances must be observed. Common designs are elongated, and often large, and typically permit no visible mounting hardware or fastening devices. Such designs make assembling within acceptable tolerances of existing designs difficult.

Moreover, these assemblies are typically suspended at heights of ten feet or more from the floor. Mounting and joining prior art structures entails cumbersome, and sometimes dangerous, procedures. These problems with prior art linear structure mounting and assembly systems for modular structures are exacerbated when the design requires that its modules contain no interior obstructions in order to provide adequate space for cables, wiring, lamps or other associated components.

A prior art system mounting assembly designed to maintain clear intra-module space utilizes a joiner aligner. However, significant problems are associated with such joiner aligners. This is an end-to-end fastening mechanism which is attached to the end of one module and frictionally engaged by insertion into the end of an adjoining module. The close force-fit of adjoining modules requires intact circumferential surfacing of the end of the joiner to ensure proper alignment. Excessive torque on the joiner aligners may cause deformations which destroy the fit necessary to attain acceptable alignment tolerances.

Moreover, these joiner aligners must be secured with retainer screws, which are awkward to insert, and provide poor resistance to displacement loads. Design specifications of many linear structures requiring close proximity of a screw axis with the longitudinal plane make mounting the required retainer screws extremely cumbersome, primarily due to the difficulty in properly turning and tightening down the screws.

Yet another prior art mechanism for joining suspended linear structures utilizes end headers. Similar to joiner aligners, end headers are also fastened to abutting ends of linear structures bolted together during installation. As with other prior art assemblies, these end-to-end interconnections require application of multiple fasteners such as bolts, machine screws, and the like in order to properly secure the assemblies. Without such fasteners, insufficient mechanical strength, i.e., resistance to longitudinal forces resulting in misalignment, is provided. Furthermore, end-to-end joiners require alternating male-female fasteners, and therefore are mounted in corresponding directions.

End-to-end securing of linear structures utilized by both joiner aligners and end headers requires exacting tolerances in order to obtain acceptable alignment and resistance to displacement forces, particularly longitudinal, i.e., tensile, loads. Moreover, the need for strict adherence to precise assembly in order to attain alignment tolerances of linear structures for mounting lighting and other fixtures must be achieved while working in awkward positions and small spaces. Such limitations may even require disassembly of lighting fixtures to gain access to the interiors of the modules, and subsequent reassembly thereof. Since interconnection of the lighting fixtures or other modules must be accomplished after the lighting fixtures are suspended from the ceiling structure, such procedures are time consuming and costly.

Furthermore, proper alignment often requires iterative adjustment of module connections and separate mounting assemblies. Such adjustments are particularly difficult if connection and mounting assemblies are not within reach, and require manipulation by at least two workers.

Assembly of prior art systems is further hindered by the need to mount and join, in tandem, more than one linear structure at a time. This coupling typically requires use of temporary support structures to keep the subassemblies in place while being aligned and mounted. The need for temporary structures to support the mounting assemblies and linear structures while they are being installed exacerbates the problems associated with difficult access and inconvenience of installation of such prior art assemblies. Some such problems are the safety risks associated with premature dismantling and collisions with these obstructive temporary support structures.

Thus, until now, there has been no system addressing the above problems with existing joint and mounting assemblies for linear fixtures; to the contrary, known assemblies perpetuate problems with alignment and stress resistance associated with prior art assemblies. Unfortunately, therefore, there persists an ongoing need for a joint and mounting assembly having accessible and readily installed connectors, which provides adequate mechanical strength for maintenance of acceptable alignment tolerances.

SUMMARY OF THE INVENTION

The present invention provides an integral assembly and a method for mounting linear structures in locked alignment, providing for an accessible, readily installed and mechanically sound mounting and joining mechanism. This invention includes retainer bars for mounting linear structures, wherein the retainer bars each have two side edges and at least one aperture, and a pin subassembly having at least two wedge pins protruding outwardly from a base, wherein the wedge pins are configured to engage opposing apertures of each of the retainer bars, each of the wedge pins having an upper edge which is sloped in an upward incline toward an inner edge of the wedge pin which provides an interface for locking against the opposing aperture of the corresponding retainer bar, and having an inner edge which is sloped in a downward incline toward the base of the wedge for fitting against the opposing aperture of the corresponding retainer bar when engaged thereby so as to join the side edges of the retainer bars in locked longitudinal alignment.

The locked interface between opposing edges of the wedge pins and corresponding apertures of the bracket and retainer bars imparts to the assembled structure both tilt for adjusting alignment and resistance to displacement forces. This locked engagement combines mechanical strength with sufficiently loose tolerances, or tilt, prior to tightening down the retainer screw into secured position upon engagement of the apertures and wedge pins to permit adjustments to align the bracket and adjacent retainer bars, and any suspended linear structures, along their lateral and longitudinal axes.

The bracket of the present invention is joinable to the retainer bars, and comprises apertures corresponding to the wedge pins. This bracket is interfitted between the retainer bars and the base of the pin subassembly such that the wedge pins successively engage corresponding apertures of the bracket and each of the retainer bars in locked engagement.

The opposing locked engagement of the apertures and wedge pins of the present invention is secured by retainer screws, which are tightened down into corresponding threaded apertures in the bracket and base of corresponding pin subassemblies. This tightening down of the retainer screws in opposing bases of the wedge pin subassemblies increases compressive loads against the engaged interface of the wedge pins and the apertures of the retainer bar. This imparts strong mechanical resistance to displacement forces and thus secures longitudinal alignment of the linear structures mounted on the retainer bar.

A preferred embodiment of the present invention includes retainer bars with round notches spaced in proximate relation to the apertures of the retainer bars and which are positioned so as to form an aperture wherethrough retainer screws are driven down when the retainer bars are aligned along their abutting longitudinal side edges. In this embodiment, the abutting retainer bars are interfitted between the screw head and the base. The locking of opposing apertures bring the retainer bars into tightened longitudinal alignment along their abutting side edges.

A particularly preferred embodiment further includes a spring through which the threaded post of the retainer screw is inserted to facilitate spring loading of the wedge pins by interfitting the bracket between the retainer bars and the base, and engaging the wedge pins in corresponding apertures of the retainer bars.

Additional aspects of the present invention include securely fastening linear structures on retainer bars. This can be done prior to or after mounting the wedge pin/retainer bar subassembly. Linear structures may include electrical cable trays, lighting fixtures, particularly elongated fluorescent lights or architectural space frames, which skilled persons will recognize as referring to autonomous linear structures.

The present invention still further provides a method for using the above assembly, which includes providing the bracket, retainer bars and pin subassemblies described herein, engaging the corresponding apertures of the bracket in locked correspondence with opposing wedge pins protruding outwardly from the base of the pin subassembly wherein the locked correspondence facilitates longitudinal alignment of two retainer bars, and wherein the round notches of the retainer bars are positioned so as to form an aperture when the retainer bars are aligned along their longitudinal side edges. The method also includes the steps of then adjusting the longitudinal alignment of linear structures mounted on the retainer bars joined by the bracket, and interfitting abutting retainer bars between the screw head and the base of the pin subassembly such that the wedge pins are successively engaged in the apertures of the bracket and the retainer bars. The method further includes inserting a retainer screw through the aperture formed by abutting round notches of adjacent retainer bars which enclose the threaded post of the retainer screw when it is in tightened position, and driving down the retainer screw through the threaded apertures of the bracket and the base of the pin subassembly successively. The retainer bars are thus joined in tightened longitudinal alignment.

The method of the present invention may further include the step of inserting a spring between the screw head and the retainer bar so as to spring load each of the pin subassemblies. The spring permits the wedge pins to positively engage and lock into the opposing slots when the retainer bar is inserted between the wedge pins and the brackets. The resulting locked correspondence secures alignment without additional support structures while permitting appropriate adjustment of the joined subassemblies prior to tightening down the mounted assembly. The automatic locked engagement provided by such spring loading also simplifies the steps of attaching and adjusting the linear structures on the retainer bars.

A particularly preferred embodiment of the present invention, which is described in detail below, includes a bracket in which the apertures are two corresponding slots which are adapted for joining a retainer bar which also has two corresponding slots for mounting linear structures, a pin subassembly, including two wedge pins protruding outwardly from a base, wherein the wedge pins are configured to engage the slots of the bracket in opposing locked correspondence.

Many advantages over the prior art stem from this invention's provision of an integral unit having joining mechanisms, which combine ease of assembly and adjustability with superior resistance to displacement forces. Such advantages include the elimination of the need for temporary support structures until the linear structures are locked into horizontally aligned position. This is made possible by the installation of individual linear structures one at a time. This advantage is facilitated by the spring-loaded, snap-in, engaged wedge pin and slot interface which locks the linear structures joined to the retainer bars into position as the retainer screws are tightened down. This important advantage eliminates the need for temporary support of linear structures. Elimination of these temporary supports significantly improves safety as a result of the strengthened connection of the wedge pin/slot subassembly. It also avoids obstacles which pose hazards due to premature dismantling and accidental collision. The self-supporting wedge pin/slot subassembly further provides the advantage of reducing the amount of hardware required to install the linear structures.

Yet additional advantages of the integral joint and mounting assembly emanate from the capability of aligning each independently suspended bracket in a vertical direction prior to the installation of linear structures. The greater accessibility and precision afforded by such independent alignment unencumbered by linear structures (which might even require disassembly) marks a significant improvement over prior art mechanisms.

The present invention still further provides the advantage of a universal mounting system having only male joiners and female retainer bars. This eliminates the need for linear structures with alternating male-female connections, and an additional, confusingly similar component which is likely to result in purchase and attempted assembly of the wrong component.

The integral mounting assembly of the present invention thus provides a more facile and mechanically strong system for joining and aligning linear structures providing substantial improvements over the prior art.

DETAILED DESCRIPTION OF THE PREFERRED EMBODIMENTS

Figure 1:
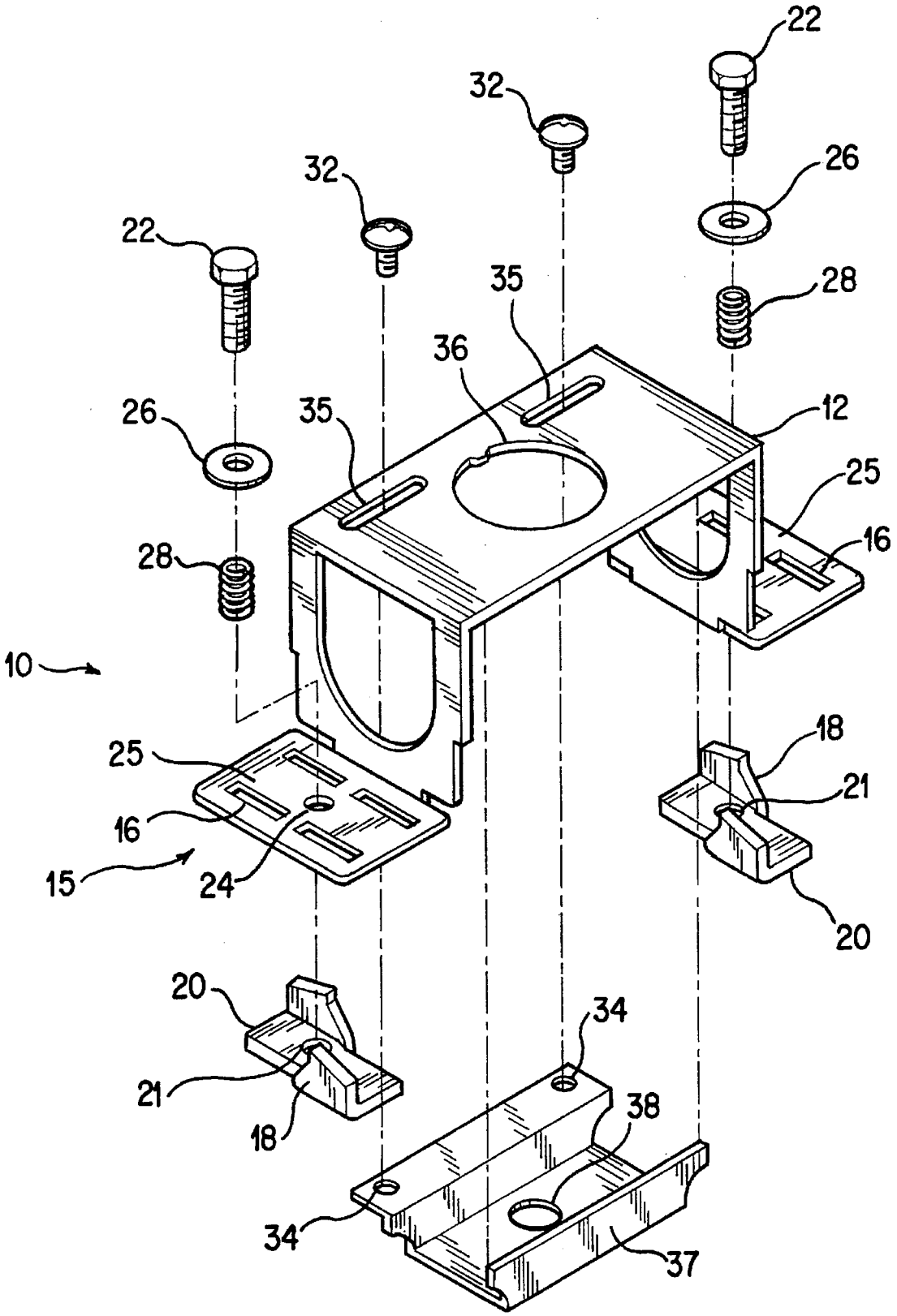
FIG. 1 depicts a perspective view of the mount and joint assembly of the present invention, in unassembled form.

Referring to FIGS. 1–3B, the preferred embodiment of the present invention is described in detail. As illustrated, assembly 10 includes a bracket 12 adapted for joining and mounting suspended linear structures. Such linear structures may include electrical cable trays, lighting fixtures, fluorescent modules, or other suspended architectural structures.

Bracket 12 has an elevated planar surface integrally adjoined to two opposing L-shaped legs with two planar outwardly extending ledges 25. Each planar ledge 25 contains four slots 16. Corresponding pin subassembly 15 includes wedge pins 18 protruding upwardly from base 20. As shown, the top of each of the wedge pins 18 are sloped upwardly toward their inner edges to facilitate engagement of wedge pins 18 and slots 16. The inner edges of wedge pins 18 engaging slots 16 are downwardly inclined toward base 20 in a slope against which slots 16 are pushed to seat wedge pins 18 into locked engagement. Thus, as retainer screw 22 is tightened, the sloped edge of wedge pins 18 forces the side edges of abutting retainer bars together in alignment along their longitudinal axes. Once retainer screw 22 is fully tightened, the two abutting ends of the linear structures are firmly seated against each other. The sloped inner edges of wedge pins 18 compensate for vertical misalignment as the linear structures are pushed together, and provides for a locking mechanism to prevent the linear structures from disengaging before the retainer screws are fully tightened. Thus, wedge pins 18 of pin subassembly 15 are configured to provide frictional, locked engagement of opposing slots 16. The locked engagement of wedge pins 18 with slots 16 automatically align bracket 12 in a vertical direction. Once wedge pins 18 snap into slots 16, the vertical ends of wedge pins 18 lock linear structure 46 into position prior to the retainer screw 22 being tightened.

Figure 2A:
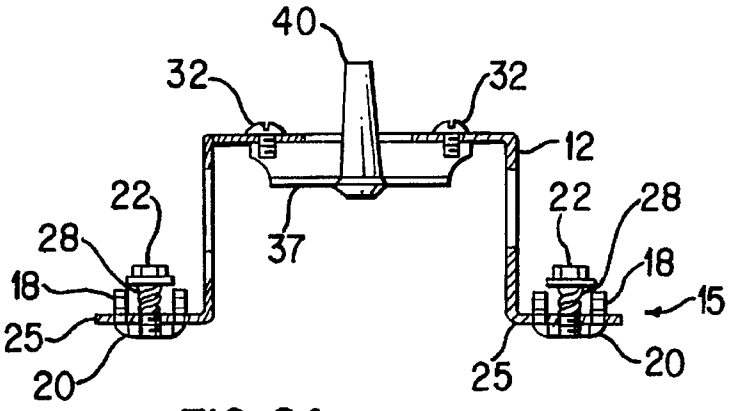
FIG. 2A depicts a cross sectional view of the assembly according to the present invention taken along lines II—II as shown in FIG. 2.
Figure 2B:
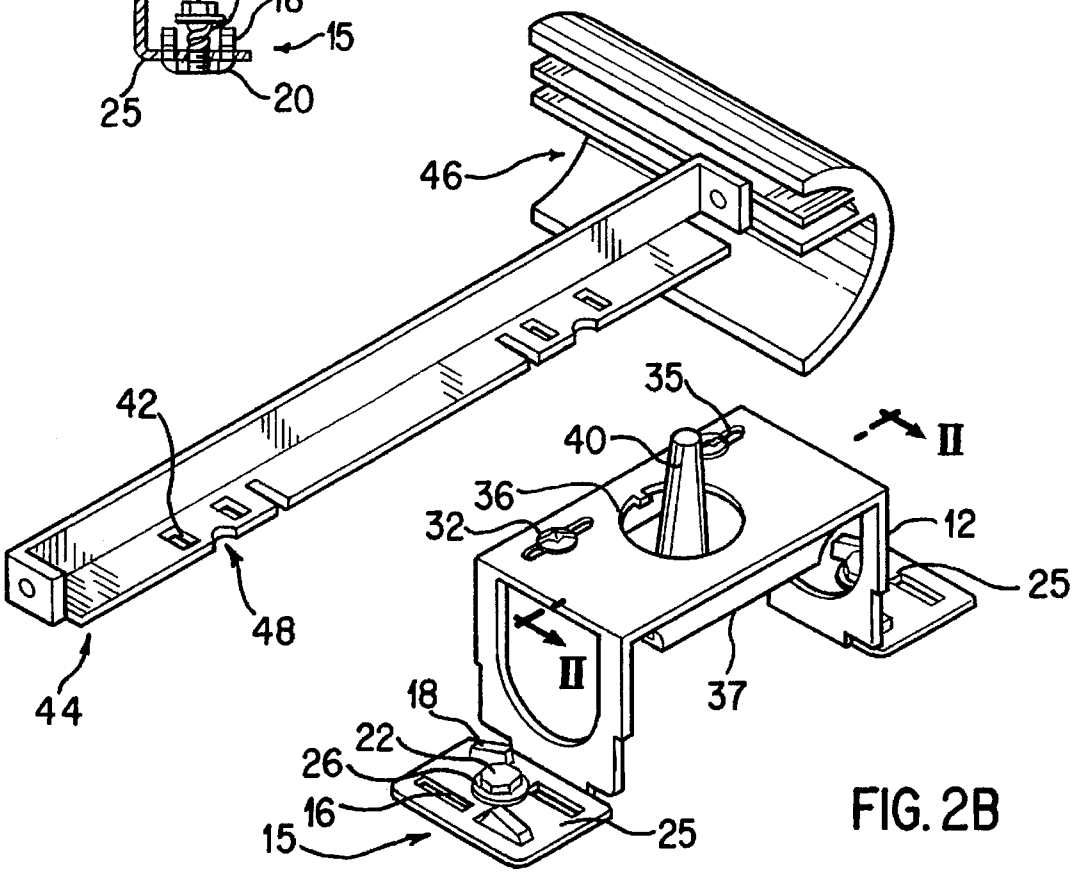
FIG. 2 depicts a perspective view of the assembly of the present invention and associated retainer bar with a mounted linear structure.

Referring now to FIGS. 2 and 2A, wedge pins 18 further engage slots 42 of retainer bar 44. Retainer screw 22 is then driven through base 20 to engage a corresponding aperture which is sized slightly larger than the threaded post of retainer screw 22. FIG. 2 further includes linear structure 46 which is securely fastened to retainer bar 44.

Sufficiently loose tolerances to permit alignment of retainer bar 44 and linear structure attached thereto are provided largely due to slots 42 of retainer bar 44 being oversized in relation to wedge pins 18 which are insertable therein. This permits wedge pins 18 to be slightly misaligned and thus not precisely parallel along their common longitudinal axes before retainer screw 22 is tightened down. Thus, the tolerances are sufficiently loose to enable tilting of the retainer bar 44 in order to bring linear structures mounted thereon into alignment. This tilting facilitates adjustment of retainer bar 44 along the longitudinal axis as retainer screw 22 is tightened down to further secure bracket 12. Appropriate longitudinal alignment of mounted linear structures may be effected as retainer screw 22 is inserted through the aperture of washer 26, then through spring 28 and aperture 24 in ledge 25, and driven in corresponding threaded aperture 21 in base 20. Linear structure 46 may thus be snapped securely into place without being propped up by temporary support structures.

Insertion of spring 28 around the threaded post of retainer screw 22 between washer 26 and ledge 25 of bracket 12 provides the further feature of spring loading. This is accomplished by inserting retainer screw 22 in threaded aperture 24, and subsequently interfitting retainer bar 44 between the ledges 25 of bracket 12 and washer 26. The spring-loaded wedge pins 18 are then fitted into slots 16. Retainer screw 22 is aligned with round notch 48, which forms an aperture sized slightly larger than the threaded post of screw 22 when aligned with an abutting retainer bar having an adjacent round notch. Wedge pins 18 and slots 16 are thereby engaged as retainer screw 22 is driven downwardly through the aperture formed by the aligned round notches and threaded aperture 21 into a tightened position. Retainer screw 22/spring 28 and wedge pin base subassembly 18/20 may be preassembled.

Spring loading of wedge pins 18 facilitates ready installation of joint and mount assembly 10 by allowing convenient "snap-in" engagement of the wedge pins 18. This mechanism supports the suspended subassembly while appropriate adjustment and alignment to set and mount linear structures 46 in finished position is undertaken. Thus, in contrast to prior art assemblies, no temporary support of the partially joined and mounted assembly is needed prior to tightening down of retainer screw 22. The tightened joint provides strong resistance to displacement loads, particularly due to compressive or longitudinal torque.

Still referring to FIGS. 1–2A, adjuster channel 37 is integrally joined to joint and mounting assembly 10 by tightening screws 32 through slots 35 into corresponding threaded apertures 34. Slots 35 permit movement of the mounting adjuster channel 37 sideways, i.e., along its longitudinal axis. This side-to-side movement provides a mechanism for leveling the linear structure 46 in a lateral direction.

Apertures 36 and 38 are provided for installation of lighting fixture 40. Apertures 36 and 38 may also be adapted for threading of wires, connectors, and the like. For example, aircraft cable and metal pendants supporting the linear structures may be inserted through apertures 36 and 38. This suspension system also utilizes pendants which may be routed to minimize the hardware required to install the linear structures.

Figure 3B:
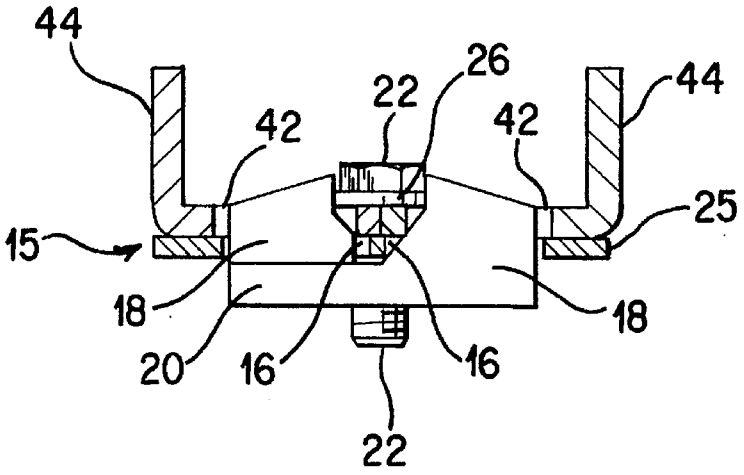
FIG. 3B depicts an exploded view of the wedge pin subassembly according to the present invention after tightening of the retainer screws.
Figure 3A:
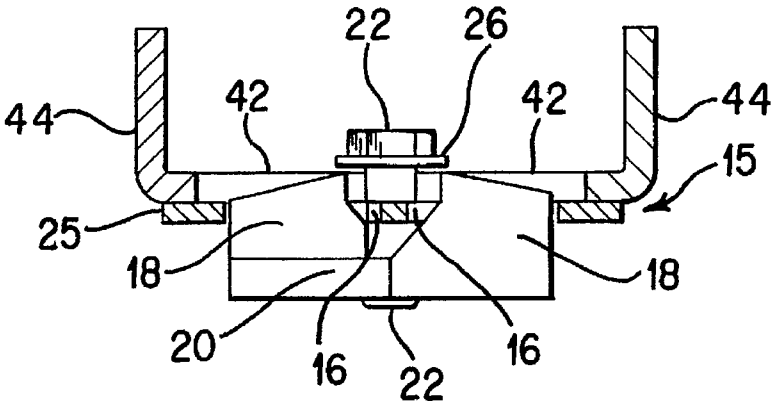
FIG. 3A depicts an exploded view of the wedge pin subassembly according to the present invention in an engaged, untightened position.

In FIGS. 3A and 3B, the exploded cross-sectional views provide a detailed illustration of the engaged pin assembly 15 in untightened and tightened positions. As shown, retainer screw 22 is inserted through round notch 48 into threaded aperture 21. Slots 16 and slots 42 of the retainer bar 44 are locked into engagement against the downwardly inclined edge of wedge pins 18. Thus, retainer bar 44 is forced inwardly into parallel and longitudinal alignment with an adjoining retainer bar. When retainer screw 22 is fully tightened, round notches 48 of adjoining retainer bars are then aligned to enclose the threaded post of retainer screw 22 to form an unthreaded aperture which is sized slightly larger than the threaded post of retainer screw 22. In locked position, the sloped inner edge of opposing wedge pins 18 exerts a compressive component on the interface locking slots 42 of retainer bar 44 and thereby provides strong resistance to potential displacement forces.

The components shown in FIGS. 1–3B may be readily fabricated by commercial suppliers.

It is to be understood that the present invention is not intended to be limited to the exact details of construction, operation, exact materials or embodiments shown and described herein, as obvious modifications and equivalents will be apparent to one skilled in the art of designing architectural lighting systems. This disclosure is intended to cover such alternatives, modifications, and equivalents as may be included within the spirit and scope of the invention as defined by the appended claims.

The following claims represent the scope of this invention to the extent that it is subject to such delimitations. It will be appreciated by those skilled in the art that the anticipated uses and embodiments of the present invention are not amenable to precise delineation, but may vary from the exact language of the claims. Thus, the following claims are drawn not only to the explicit limitations, but also to the implicit embodiment embraced by the spirit of the claims.

What is claimed is:

1. An integral assembly for mounting a plurality of structures end-to-end, in locked alignment, comprising:

(a) retainer bars joinable to the ends of the structures to be brought into locked alignment, wherein each retainer bar has a longitudinal axis and two side edges along their longitudinal axes and at least one aperture, said aperture being positioned along the retainer bars so as to be in an opposing relationship to an aperture on the retainer bar joined to the end of the structure to be brought into locked alignment; and (b) a pin subassembly having at least two wedge pins protruding outwardly from a base, wherein the wedge pins are configured to engage opposing apertures of each of the retainer bars, each wedge pin having an upper edge which is sloped in an upward incline toward an inner edge of the wedge pin providing an interface for locking against the opposing aperture of the corresponding retainer bar, and having an inner edge which is sloped in a downward incline toward the base of the wedge pin for fitting against the opposing aperture when engaged thereby so as to join the side edges of the retainer bars in longitudinal alignment; and (c) a bracket joinable to the retainer bars, wherein the bracket comprises apertures corresponding to the wedge pins, and wherein the bracket is interfitted between the retainer bars and the base of the pin subassembly such that the wedge pins successively engage corresponding apertures of the bracket and each of the retainer bars in locked engagement.

2. The assembly of claim 1, wherein the apertures of the bracket and retainer bars are sized in relation to corresponding wedge pins so as to provide sufficient tolerances to permit adjustment of alignment along the axes of adjacent retainer bars.

3. The assembly of claim 2, wherein each of the retainer bars further comprise notches spaced in proximate relation to the apertures of the retainer bars and which are positioned so that the notches form an aperture through which the threaded portion of the retainer screw is insertable when the retainer bars are aligned along their abutting longitudinal edges such that the retainer bars are interfitted between the screw head and the bracket in secured alignment.

4. The assembly of claim 2, wherein each of the retainer bars further comprise round notches spaced in proximate relation to the apertures of the retainer bars, wherein the round notches are positioned so as to form an aperture through which retainer screw is insertable when the retainer bars are aligned along their abutting longitudinal side edges such that the retainer bars are interfitted between the screw head and the bracket in secured alignment, and further comprising a spring through which the threaded portion of the retainer screw is insertable to facilitate spring loading of the wedge pins by interfitting the bracket between the retainer bars and the base, and engaging the wedge pins in corresponding apertures of the retainer bars.

5. The assembly of claim 2, wherein each of the retainer bars further comprise round notches spaced in proximate relation to the apertures of the retainer bars, wherein the notches are positioned so as to form an aperture through which the threaded portion of the retainer screw is insertable when the retainer bars are aligned along their abutting longitudinal side edges such that the retainer bars are interfitted between the screw head and the bracket in secured alignment, and wherein the apertures of the bracket comprise corresponding slots for locked engagement of the opposing wedge pins and further comprising a spring through which the threaded portion of the retainer screw is insertable to facilitate spring loading of the wedge pins when the bracket is interfitted between the retainer bars and the base, and the wedge pins are engaged in corresponding slots of the retainer bars.

6. The assembly of claim 1, wherein the base of the pin subassembly and the bracket each have corresponding apertures, and further comprising a retainer screw having a head and a threaded portion insertable through the apertures of the bracket and base of the pin subassembly successively so as to tighten the bracket.

7. The assembly of claim 1, wherein the linear structures to be mounted comprise lighting fixtures.

8. The assembly of claim 1, wherein the linear structures to be mounted comprise electrical cable trays.

9. The assembly of claim 1, wherein the linear structures to be mounted comprise architectural space frames.

10. A method for mounting a plurality of structures end-to-end in locked alignment, comprising:

(a) providing a bracket joinable to two retainer bars mountable to linear structures, wherein the bracket has a threaded aperture and two slots, and each of the retainer bars has at least one slot and notches spaced in proximate relation to the slots of the retainer bars such that the notches form an aperture when the retainer bars are aligned along their longitudinal side edges;

(b) providing a pin subassembly having at least two wedge pins protruding outwardly from a base, wherein the base has a threaded aperture;

(c) engaging the corresponding apertures of the bracket in locked alignment with corresponding wedge pins of each of the pin subassemblies;

(d) interfitting the retainer bars between the screw head and the base such that the apertures of the bracket and the retainer bars successively engage the wedge pins in locked alignment, and wherein the engagement facilitates longitudinal alignment of the retainer bars;

(e) adjustably aligning the retainer bars and linear structures mounted thereon;

(f) inserting retainer screws through corresponding round notches of the retainer bars interfitted between the screw head and the base; and (g) driving the retainer screw into the threaded apertures in the base of the corresponding pin subassemblies through the aligned round notches of the retainer bars so as to secure the retainer bars into joined alignment.

11. The method of claim 10, further comprising inserting a spring between the screw head of the retainer screw and the retainer bars so as to spring load the wedge pin into locked alignment with the slot, and to thereby lock the retainer bar into position.

12. An assembly for mounting a plurality of structures end-to-end in locked alignment, comprising:

(a) a bracket joinable to two retainer bars joinable to each end of the structures, wherein the bracket has two slots, and the retainer bars each have at least one slot and a round notch;

(b) two pin subassemblies each having wedge pins protruding outwardly from a base, wherein the wedge pins are configured to engage corresponding slots of the bracket and the retainer bars in opposing locked alignment, and wherein the base has a threaded aperture;

(c) two retainer screws, each having a head and a threaded portion, wherein the threaded portion of the retainer screws are insertable through aligned round notches of abutting retainer bars interfitted between the screw head and the bracket such that the wedge pins successively engage the slots of the bracket and the retainer bars when the threaded portion of the screws are driven through aligned round notches of the retainer bars into the apertures of the bracket and the corresponding bases of each of the pin assemblies so as to secure the abutting retainer bars into joined alignment;

(d) two springs insertable between the heads of the retainer screws and the bracket so as to facilitate spring loading of the wedge pins when the retainer bars are interfitted between the screw heads and bracket, thereby locking the retainer bars into position while the threaded portion of the screw is partially inserted into the base of the wedge pin; and (e) driving down the threaded portion of the screw through the round notch and threaded aperture of the base so as to secure the retainer bars into tightened alignment.

* * * * *